United States Patent [19]

Rawlins

[11] Patent Number: 4,837,886

[45] Date of Patent: Jun. 13, 1989

[54] POOL CLEANING DEVICE

[76] Inventor: David Rawlins, 4511 San Marino Dr., Davis, Calif. 95616

[21] Appl. No.: 102,107

[22] Filed: Oct. 2, 1987

Related U.S. Application Data

[63] Continuation-in-part of Ser. No. 916,188, Oct. 7, 1986, abandoned, which is a continuation-in-part of Ser. No. 707,245, Mar. 1, 1985, Pat. No. 4,686,728.

[51] Int. Cl.[4] ..... E04H 3/20

[52] U.S. Cl. ..... 15/1.7

[58] Field of Search ..... 15/1.7; 134/167 R, 168 R; 210/169

[56] References Cited

U.S. PATENT DOCUMENTS

| | | | |
|---|---|---|---|
| 3,384,914 | 5/1968 | Wilhelmsen | 15/1.7 |
| 3,675,261 | 7/1972 | Burgess | 15/1.7 |
| 3,765,432 | 10/1973 | Goodin | 134/168 R |
| 3,805,815 | 4/1974 | Goodin | 134/167 R |

*Primary Examiner*—Edward L. Roberts

*Attorney, Agent, or Firm*—Majestic, Parsons, Siebert & Hsue

[57] ABSTRACT

A pool cleaning device comprises a housing defining a chamber therein having a rudder and an air injector. When air is injected into the chamber, the housing rises from the pool bottom to the surface. The device further includes a float valve which causes the air in the chamber to escape when the device reaches the surface of the water. The housing has a port communicating with the water in the pool for letting in water to replace the air escaping through the float valve, causing the device to sink to the pool bottom after the air has been released from the chamber. The rudder causes the housing to move laterally during its ascent and descent. A brush attached to the housing scrubs the side wall and bottom of the pool. The ascent and descent of the device also causes the rudder to operate a gear mechanism causing the housing to rotate relative to the pool, thereby ensuring that the device will move laterally in different directions to cover the entire pool and to retrieve itself from corners.

19 Claims, 4 Drawing Sheets

POOL CLEANING DEVICE

CROSS REFERENCE TO RELATED APPLICATIONS

This application is a continuation-in-part of application Ser. No. 916,188, filed Oct. 7, 1986, now abandoned which is in turn a continuation-in-part of Ser. No. 707,245, filed Mar. 1, 1985, now U.S. Pat. No. 4,686,728.

BACKGROUND OF THE INVENTION

This invention relates to pool cleaning devices; and, more particularly, to an automatic device for simultaneously cleaning and vacuuming a pool.

DESCRIPTION OF THE PRIOR ART

The majority of pool cleaners known in the art work on the principle of high pressure water jets generated by means of an additional pump. The purpose of these devices is to lift and suspend impediments causing their eventual exit through the main drain. Since only loose matter is dislodged by this method, long-lying algae bearing dirt is untouched and requires eventual scrubbing by hand by means of a long handled, cumbersome brush from the pool edge.

A further problem of the prior art is that, even though they eventually clean the water in the pool, such devices often have no effect on the walls of the pool, especially the side walls.

In U.S. Pat. No. 4,686,728, the teachings of which are incorporated herein by reference, I describe a pool cleaner which, using its own substantial weight, scours the walls and floor of the pool by means of brushes.

The pool cleaner, upon landing on the floor of the pool, activates a controlled closing of the main vacuum door which, once closed, allows the vacuum within the base of the vessel to act upon a large rubber diaphragm which is pulled down into the evacuating water chamber and so enlarges the air chamber causing immediate buoyancy. The vessel rises to the surface by random direction brushing all surfaces it comes into contact with.

The vessel, having reached the surface of the pool, can only descend by the opening of the main door. This is achieved by means of the vacuum working on a small orifice located beneath the valve piston and, aided by the weight suspended at the door, causes the door to open. The vessel then drops randomly brushing as well as vacuuming all debris in its path.

At all times, while the door of the vessel remains closed, a vacuum controlled valve inserted at the pool's skimmer allows surface skimming to continue thereby preventing strain on the pool pump.

All debris captured by the vessel is directed to the pool's own filtration system. Since all swimming pools, without exception, are equipped with a pump and filter to obtain water purification, the pool cleaner of U.S. Pat. No. 4,686,728 requires no additional energy-using device to operate, but uses the pool's existing suction to perform its entire function.

The pool cleaning device in U.S. Pat. No. 4,686,728 relies upon a "timing" valve and a rubber diaphragm for proper operation. Such diaphragms are susceptible to attack by the chemicals in the pool water and may leak or otherwise deteriorate rendering the device inoperative or not as efficient. Also, proper suction is necessary in such a device and this requires a "timing" valve. There is thus a need for a pool cleaning device in accordance with the teachings of application Ser. No. 707,245 that eliminates the need for a diaphragm and "timing" valve to control the same and can be operated with a pump of low horsepower.

SUMMARY OF THE INVENTION

This invention is directed towards a pool cleaning device comprising a housing, a brush connected to the housing and a rudder movably connected to the housing. The device further includes means for injecting a gas into a chamber in the housing, causing the housing to rise from the pool bottom to the surface of the water in the pool. The device further comprises a float valve adapted to release the gas from the chamber in the housing when the device reaches the water surface in the pool. When the gas is released, water enters the chamber, causing the device to fall in the pool. When sufficient gas is once more injected into the housing to give it enough buoyancy, the device again rises to the water surface. The pool cleaning device thus avoids the use of rubber diaphragms or the use of any timing devices and is simply controlled by injecting air into the device.

The housing has a forward end and a tail end. The rudder is in the shape of a plate so connected to the housing that it is movable between two positions, the rudder also having a forward end and a tail end. When the housing is rising in the water, the rudder is in the position where its forward end is at a higher elevation than its tail end; when the housing is falling, the forward end of the rudder is lower than its tail end. The reaction force exerted by the water against the rudder causes the housing to move laterally in the forward direction as well as vertically, where the forward direction is defined with respect to a line on the rudder connecting the highest part of the rudder to the lowest part. In the preferred embodiment, the rudder is pivoted to the housing at a point on near the forward end of the housing to provide lever action in enhancing the lateral motion of the device.

The rudder causes the device to move laterally or sideways in a direction indicated by the rudder as the device rises or falls. As the device hits the side walls of the pool, the brush on the device scrubs the side walls. The device is preferably of sufficient weight to give strength to the scrubbing. Preferably, brushes or other cleaning accessory may be attached to the bottom of the device to scrub the pool bottom as the device lands on the pool bottom.

It has been recognized in the pool cleaning art that it is important for any pool cleaning device to be capable of automatically moving itself to different parts of the pool in order to filter and purify the water in different pool areas and to brush and scrub the side walls and bottom of the pool. The structure of the pool cleaning device disclosed herein ensures that the device reaches different parts of the pool and that the device can retrieve itself from corner areas in the pool. Thus, another aspect of the invention is directed towards a mechanism activated by the rudder for rotating the housing. The rudder is movably connected to the housing, where the rudder is movable relative to the housing between two positions of the rudder. The rudder is in a first position when the housing is rising from the pool bottom to the surface of the water. Upon the device reaching the water surface, the rudder moves to a second position.

Upon the device falling to the pool bottom, the rudder will move from the second to the first position.

At a predetermined point in the rising or falling cycle of the device, the rudder activates the mechanism for rotating the housing. The device moves laterally along a direction indicated by the rudder in its rising and falling motions. The rotation of the housing also rotates the rudder, thereby causing the device to move laterally in a different direction than before the rotation. In other words, the rising and falling motions of the device automatically cause the rudder to activate the mechanism for rotating the housing relative to the pool, and causes the device to move in a different direction than before. This feature ensures that the device will rotate and move in a different direction from that of a previous rising or falling cycle. Thus, if the device is caught in a corner of the pool, it will simply rise and fall along the side wall near the corner, where the housing is caused to rotate a number of times if necessary in a number of rising and falling cycles, until the housing and rudder are rotated to a direction in which the device can retrieve itself from the corner. Such feature has the further advantageous in that, while it is rising and falling along the side wall, it will brush against the side wall and pool bottom near the corner, thereby cleaning the pool surfaces near the corner which may be otherwise hard to reach by means of conventional pool cleaning devices.

DESCRIPTION OF THE PREFERRED EMBODIMENT

Figure 1:
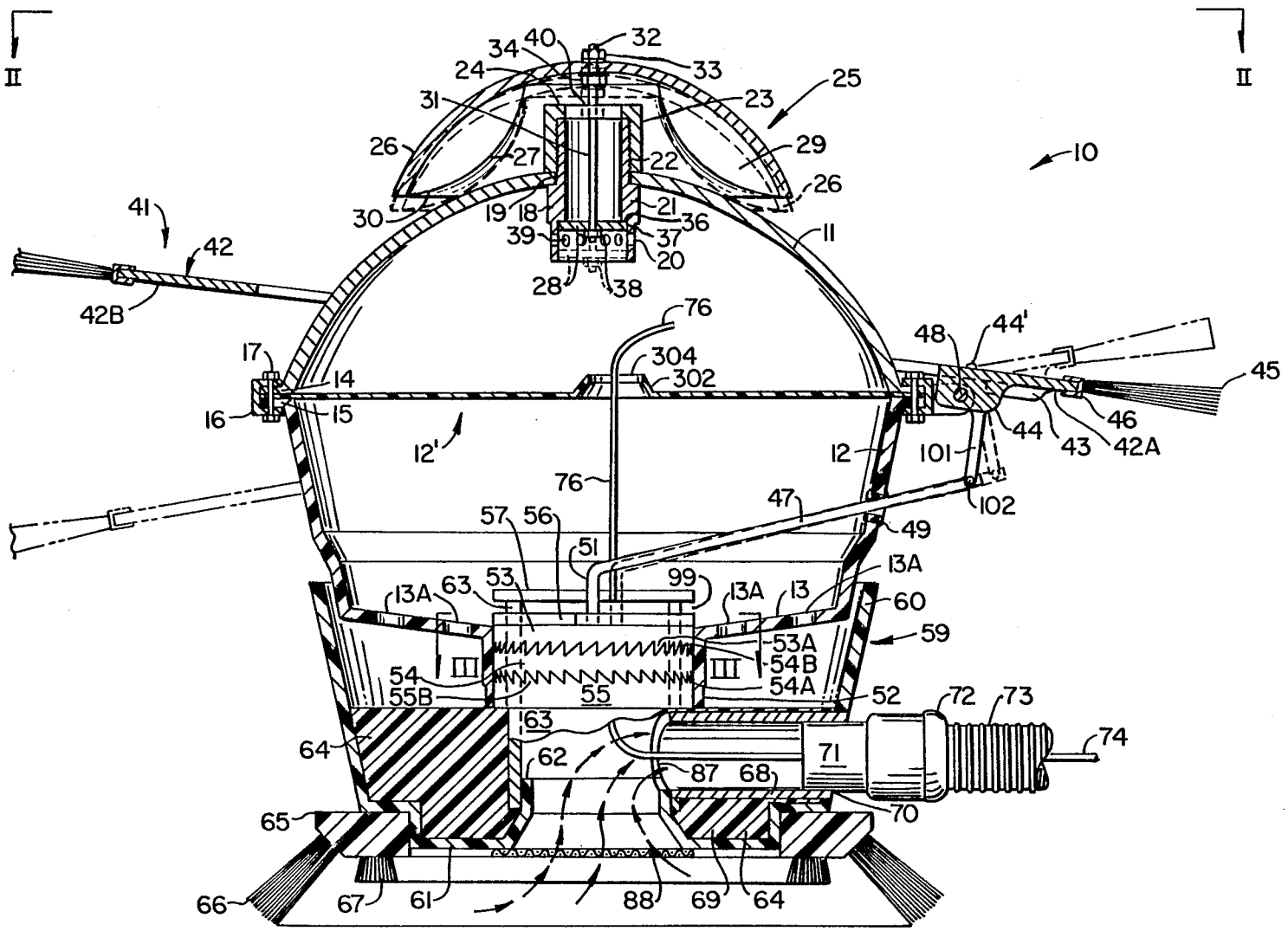
FIG. 1 is a vertical sectional view of a pool cleaning device in accordance with the teachings of the invention.

Referring now to FIG. 1 of the drawing, a pool cleaning device 10 is shown having a main housing comprised of a pair of upper and lower mating sections 11 and 12, respectively. Section 11 may be generally hemispherical whereas section 12 may be generally semi-circular with a truncated lower downwardly sloping bottom wall 13. Sections 11 and 12 may be formed of any suitable materials, such as section 11 being of spun stainless steel and item 12 being of plastic. Section 11 also includes a flat annular peripheral flange 14 adapted to mate with a flat annular peripheral flange 15 on section 12. An annular clamp 16 encircles and retains therebetween flanges 14 and 15. Any suitable means may be provided for securing the clamp 16 to flanges 14, 15 such as a suitable nut and bolt 17 passing through aligned apertures in clamp 16 and flanges 14, 15 at spaced locations around the circumference of device 10.

A disc 12' with a peripheral flange is also clamped at its flange between the peripheral flanges of sections 11, 12 by suitable means such as nut and bolt 17. The purpose of the disc will be explained below.

A tube 18 is provided at generally the center of upper section 11 passing through a threaded opening 19 therein having a lower generally cylindrical portion 20, an enlarged integral generally cylindrical mid-portion 21 and an integral generally cylindrical thin walled portion 22 threaded into opening 19. Portion 22 is externally threaded as shown and a cap 23 is threaded to portion 22 abutting at one end against the outer surface of section 11 and having an upper apertured integral wall portion 24 abutting against the upper end of threaded portion 22. Thus, cap 23 and tube 18 clamp upper section 11 therebetween as shown.

A valve 25 is associated with cap 23 and tube 18. Valve 25 includes a curved outer wall 26 having annular curved walls 27, around the inner portion of cap 23, and spaced from the interior of wall 26 to form space 29, respectively. This space 29 may be filled with a suitable foam material 30 in the float valve.

The foam material 30 should be lighter than water so that when the device 10 is submerged in water, valve 25 would tend to rise upwards. In the preferred embodiment, space 29 is simply filled with a gas, such as air.

A number of holes 39 are provided preferably at the same horizontal level in the bottom portion 20 of tube 18, through which the chamber inside sections 11 and 12 may communicate with the space inside tube 18 depending on the position of rubber sealing piston or washer 28. A shaft 31 extends through wall 26 having a threaded end 32 receiving a nut and washer 33 on the outside and a like nut and washer 34 on the interior for securing shaft 31 to wall 26. The other end of shaft 31 is connected to piston or washer 28 slidably and sealingly connected to the inside surface of portion 20. The movement of piston 28 is constrained by shoulder 36 and the distance between wall 26 and wall 24 of cap 23 shown in FIG. 1. Thus; when the device 10 is submerged, the buoyancy of the medium in space 29 causes valve 25 to tend to move upwards, thereby causing piston 28 to be moved by shaft 31 upwards until piston 28 abuts shoulder 36. When device 10 rises to the water surface, wall 26 and the medium in space 29 rises above water, causing the wall 26 and the medium in space 29 to lose buoyancy. Thus, when wall 26 rises above water, it simply acts as a weight, thereby pushing piston 28 downwards through shaft 31 until inside surface of wall 26 is in contact with cap 23, thereby stopping the motion of piston 28. Thus, the upper and lower limits of travel of piston 28 are defined. Holes 39 in portion 20 are positioned such that they are between the two positions of piston 28 so that when piston 28 is in its upper position, air inside sections 11, 12 cannot escape through holes 39 to the water surface. But when piston 28 is in its lower position, holes 39 permit communication between the chamber and the space inside tube 18, thereby permitting the air inside the chamber to escape through the holes 39 in portion 20 and holes 40 in wall 24 to the water surface.

Thus, when device 10 is submerged, valve 25 tends to rise, thereby sealing off the chamber in sections 11, 12, preventing the air therein from escaping. Upon wall 26 rising above the surface of the water, the air inside sections 11, 12 is permitted to escape through holes 39. Upon the air escaping through the holes 39, water quickly enters the chamber in sections 11, 12 through holes 13A. When much of the air in sections 11, 12 has been let out and replaced by water through holes 30A, device 10 quickly sinks. When wall 26 is once again submerged, the buoyancy of the medium in space 29 pulls piston 28 upwards to its upper position, thereby sealing off holes 39 and preventing any more air from escaping. However, the rate of air injected into the chamber in sections 11, 12 is such that the air in the chamber when the device is still falling is inadequate to cause the device to rise. Valve 25 remains sealed until again enough air is let into the chamber to cause device 10 to rise to the surface of the water upon which the above described cycles repeat itself.

Figure 2:
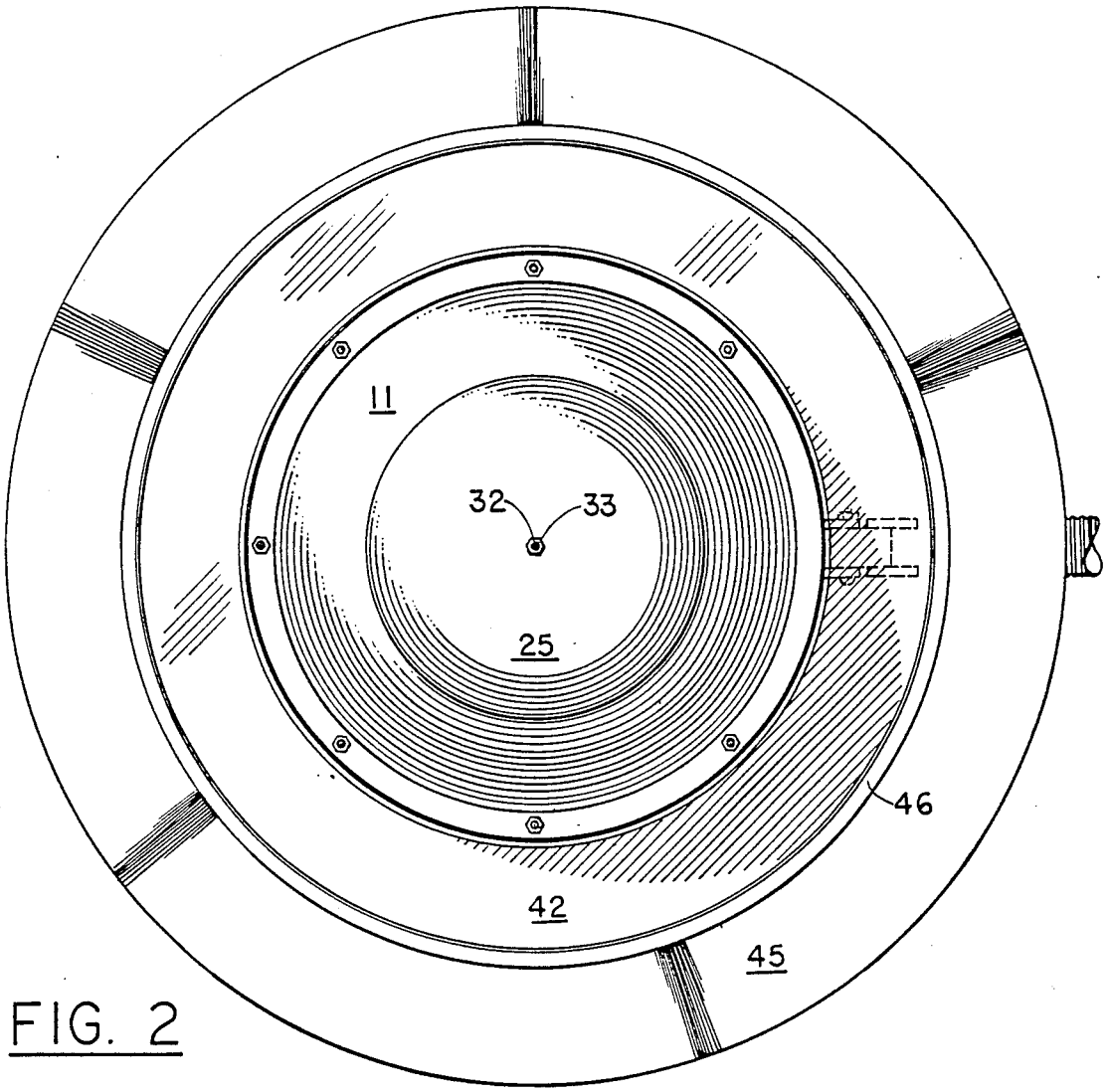
FIG. 2 is a view taken along lines 11—11 of FIG. 1.

As seen in FIG. 2, a rudder 41 surrounds the interconnected upper and lower sections. Rudder 41 includes an annular collar 42 fixed to a hinge 44 by a screw 44' which hinge is pivotally connected to clamp 16. A stop 43 is provided on the underside of collar 42.

As seen in FIG. 2, a brush 45 extends totally around the collar 42, fixed thereto in any suitable manner, as by a clamp 46 snap fitting on to the outer peripheral edge of collar 42 as seen in FIG. 1.

An actuating lever 101 (FIG. 1) is fixedly connected to hinge 44 near pin 48 and terminates at its free end in a hinge 102 which connects it to a lever 47. Lever 47 passes through a grommet 49, such as a rubber grommet, mounted in an opening in the side of lower section 12 and terminates at its free end in an angled downwardly extending portion 51. It is to be understood that sufficient play between lever 47 and the grommet opening is provided to allow lever 47 to move within grommet 49 as will be discussed. Lever 47 may be of brass or other suitable material.

Figure 3:
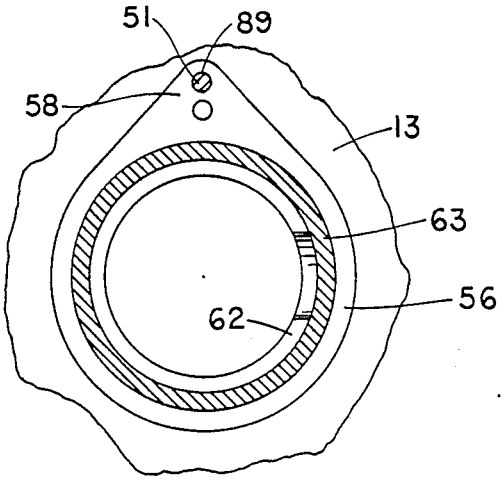
FIG. 3 is a section taken along lines 111—111 of FIG. 1.

As seen in FIG. 1, bottom wall 13 slopes inwardly and downwardly to the center to form a generally tubular bottom section 52. Disposed within the confines of this tubular section 52 are three ring gears and a flanged annular plate 56. A pipe preferably having an internal diameter of about 3 inches, and designated 63 is disposed within and spaced from tubular bottom section 52. A circular stop 57 is fixedly mounted at the top edge of the pipe 63. Movably disposed upon said pipe 63 just beneath said stop 57 is flange plate 56 which is seen also in FIG. 3. In FIG. 3 the flange 58 of this plate 56 has a bore 89 into which is fixedly disposed downward portion 51 of actuating lever 47.

Figure 6:
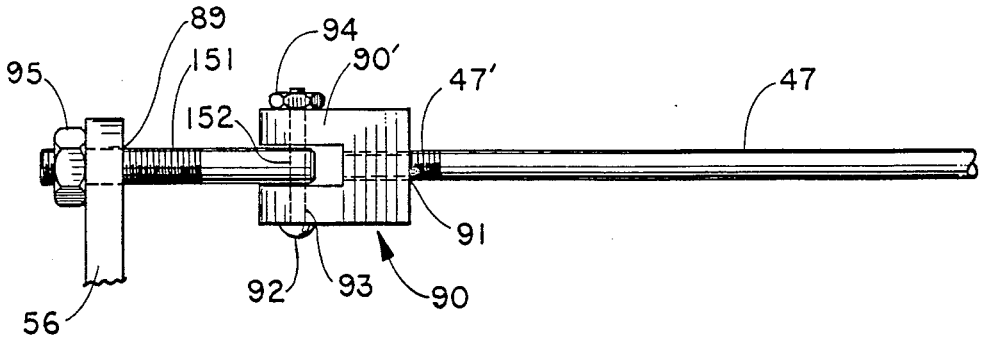
FIG. 6 is a closeup persepective view of a variant of one section of this invention.

A preferred variant of the attachment of the downward portion 51 from lever 47 is shown in FIG. 6, the discussion of which will follow hereinafter.

On the underside of the flange plate 56 is mounted the first of the three ring gears designated 53, the teeth of which 53A face downwardly. Gear 53 is not secured to tube 63.

Gear 54 is secured as by adhesing it on its inside surface, to said pipe 63 beneath gear 53. Gear 54 has teeth facing upwardly 54B engaged with the teeth 53A of gear 53; and teeth facing downwardly 54A in engagement with the teeth 55B of gear 55. Gear 55 however, is fixedly mounted as by adhesing its outer surface to the interior surface of tubular section 52.

The diameter of each of the three ring gears is identical and the diameter is sized to permit the gears to be interposed between the tubular section 52 and the pipe 63, per FIG. 1.

While in the embodiment shown, three ring gears are used, it will be understood that only two gears may be sufficient. For example, gear 54 may be eliminated as long as gears 53 and 55 have matching teeth.

Thus, movement of lever 47 causes movement of portion 51 which in turn causes flange plate 56 to rotate forwardly, and a second movement of portion 51 causes flange plate 56 to rotate backwardly in a continuous reciprocating fashion. Since gear 53 is affixed to said flange plate it moves in like fashion. Gear 53 meshes with gear 54 which, as was mentioned, is glued or otherwise secured to pipe 63, such that rotation of gear 53 rotates gear 54, and thus 63, and since pipe 63 is glued to or otherwise secured to port 62, the bottom housing 59 rotates in the direction that pipe 63 rotates. In the preferred embodiment, the bottom housing 59 is much heavier than sections 11, 12 so that when sections 11, 12 are rotated relative to the bottom housing 59 by the gears, housing 59 essentially remains stationary relative to the pool, whereas the sections 11, 12 are rotated relative to the pool.

When the device is rising, the rudder and lever 41 are in the dotted line position in FIG. 1. After the device rises to the water surface and starts falling, the rudder 41 and lever 47 move to the solid line position in FIG. 1. This causes lever 47 (through portion 51) to move plate 56 for a short distance in a clockwise or counter-clockwise direction. See also FIG. 3. Since plate 56 is attached to gear 53, this causes gear 53 to push gear 54 to rotate by one or more notches. Upon the device hitting the pool bottom, the rudder and lever return to the dotted line position. When portion 51 moves from its solid line position to its dotted line position, plate 56 and gear 53 disengage from gear 54, rise into gap 99 and slide relative to gear 54 by one or more notches and re-engage. The cycle is then ready to repeat itself for continually rotating gear 54 relative to plate 56 is a given clockwise or counter-clockwise direction so as to rotate sections 11, 12 relative to the pool.

The action of the rudder in enabling the device to move laterally in the water as it rises or falls will now be described. When the device 10 moves laterally, the forward portion of the housing (11, 12) will be referred to as the forward end and the trailing portion its tail end. Collar 42 of rudder 41 is pivotally connected to sections 11, 12 by hinge 44 at or near the forward end of the device 10. As is evident from FIG. 1, the rudder is movable between the solid line position and the dotted line position depending on the motion of the device. Thus when the device rises in water, the resistance of the water causes the rudder to move to the dotted line position, since the collar is hinged to one side of the housing. As the housing rises in water, the reaction force exerted on the collar by the water imparts a lateral force on the device, causing lateral motion. The lateral motion is in the forward direction which may be defined with respect to the highest portion of annular plate 42 and its lowest portion in the two positions. When the device rises, portion 42A is the highest portion and portion 42B the lowest; when the device falls portion 42A is the lowest and portion 42B the highest. During both the falling and rising motions, portion 42A is the forward end and portion 42B the tail end of the collar and rudder in the lateral motion of the device.

Since gear 55 meshes with gear 54 when gear 54 rotates, and gear 55 being glued or otherwise secured to tubular section 52 causes it, 52, to rotate, thereby causing upper and lower sections 11, 12 to simultaneously rotate therewith.

Turning briefly to digress to FIG. 6, wherein a variant of lever 47 with downward portion 51 is shown. In this view the stop 57, which prevents flange plate 56 from coming off pipe 52 has been omitted for ease of understanding. Since there has already been a full discussion on the disposition and workings of gears 53, 54 and 55, repetition is not needed.

Here lever 47 is threadedly engaged by threads 47' into the threaded bore 91 of clevis 90. Clevis 90 has a pair of spaced side plates 90'. The equivalent of downward portion 51, now designated 151, comprises a threaded member which has a through-bore 152 at one end thereof. Threaded cross pin 92 passes through aligned bores 93, in the two plates 90', and is retained in place by nut 94. Threaded member 151 passes through opening 89 of flange plate 56 and is held in place by nut 95 therebeneath. An optional second nut not seen can be disposed on threaded member 151 just above flange plate 56 if desired for stability.

The discussion now returns to FIG. 1 for a discussion of the bottom housing 59, which is preferably constructed of the same plastic as lower section 12.

Bottom housing 59 surrounds the lower end of lower section 12 having a peripheral outwardly flared side wall 60 and an inwardly stepped bottom wall 61. Bottom wall 61 extends inwardly and upwardly to form a lower port 62. The glued pipe 63 is coupled to port 62 on the interior thereof having lower ring gear 55 secured thereto. The interior of walls 60, 63 and 61 form a ballast compartment 69 filled with ballast 64, as shown.

An annular brush retainer 65, having a plurality of outwardly angled annularly extending bristles 66 and downwardly extending annular bristles 67 is provided fixedly secured to wall 61 at the stepped portions thereof.

A partition wall 68 is provided interiorly of one side of the ballast compartment forming a port for receiving through opening 70 in the side wall 60 a terminal tubular end 71 coupled to a ball joint 72 having a vacuum hose 73 connected thereto. A hollow air hose 74 leading from a compressor 75 (FIG. 4) at the pool surface extends through the interior of hose 73, preferably coaxially past joint 72, end 71, wall 63, up through suitable aligned openings in gears 53 to 55 and terminates at vertical end 76 opening into the interior of device 10 above bottom wall 13 as shown in FIG. 1.

Operation of the Device

Figure 4:
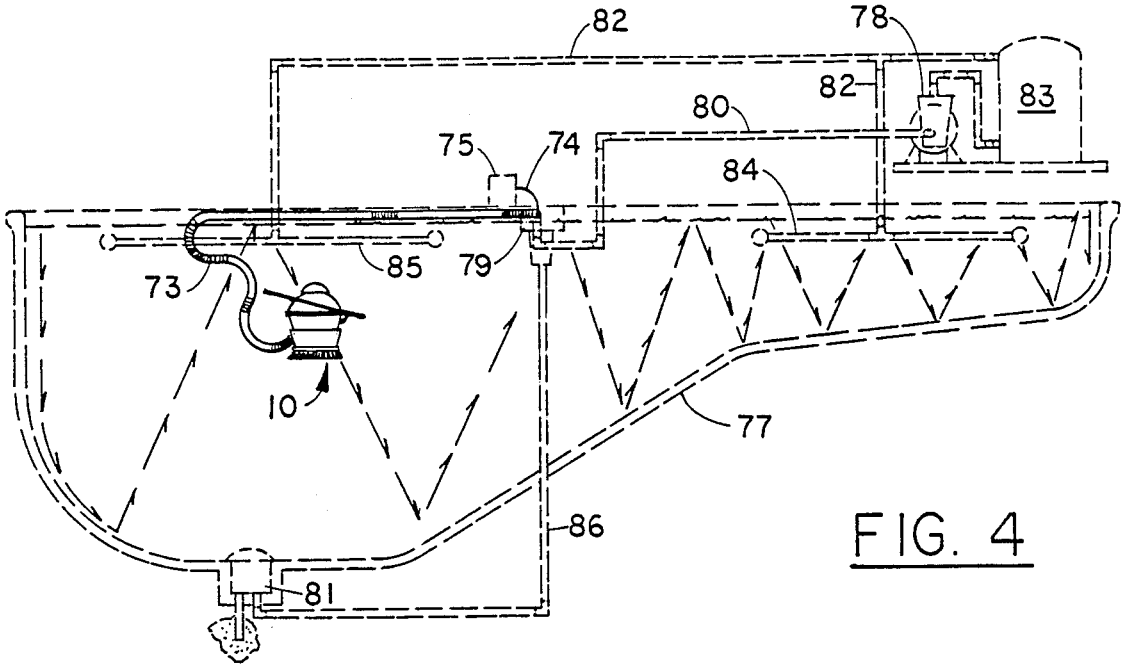
FIG. 4 is a vertical view, partly in section, of a conventional swimming pool showing the device of FIGS. 1 to 3 installed therein.
Figure 5:
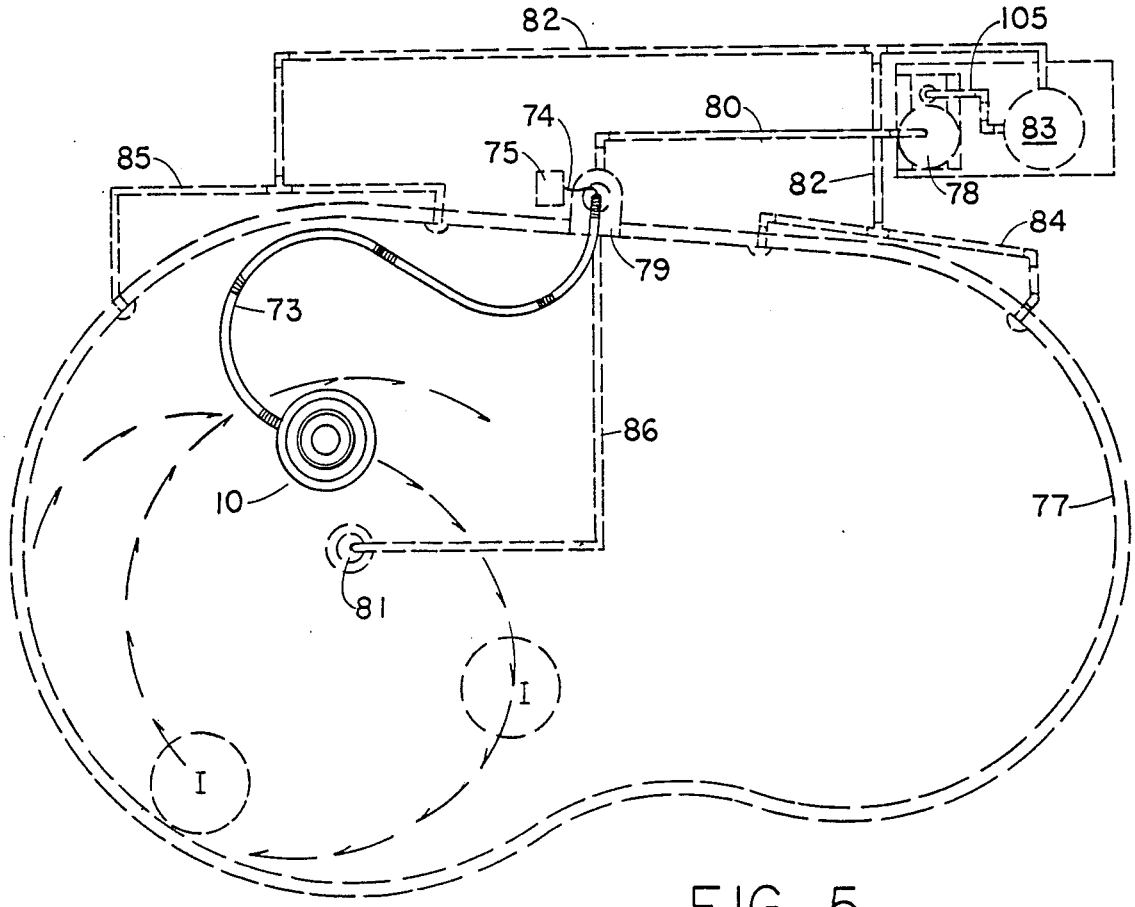
FIG. 5 is a top plan view of the pool of FIG. 4.

The operation of the device 10 can be easily seen in FIGS. 4 and 5. A conventional pool 77 is shown having a pool pump 78 at the surface. Piping 80 leads from pump 78 to skimmer 79 and to drain 81 via a piping 86. Piping 82 leads from filter 83 connected to pump 78 via piping 105 to surface skimmers 84 and 85, opening in the pool side walls as shown, all this as is well known in the pool art.

Hose 73 is attached to the pool skimmer 79. The arrows (FIG. 4) shows the path of device 10 as is descends and ascends, brushing all surfaces, walls and pool floor as it comes into contact with them and vacuuming while descending and being stationary on the pool floor before rising again.

The curving direction of device 10 in descent and ascent is shown in FIG. 5 which is obtained by the varying movements of rudder 41.

In FIG. 1 phantom line positions of rudder 41, lever 47 and portion 51 show the rising position of device 10. That is, the device 10 sits on the floor of the pool and compressor 75 is actuated to inject air via hose 74 into the interior of sections 11,12. As soon as enough air builds up inside of device 10, the device 10 begins to rise in pool 77 (see FIGS. 4 and 5) due to its inherent buoyancy. Upon reaching the water surface, valve 25 releases the air in device 10, and the rudder 41 moves to the solid line position which rotates ring gear 53 one notch. Gear 53 moves middle ring gear and rotates it one notch. The middle ring gear 54 thus is engaged by gear 53 and moves around one notch at a time, 360 degrees. Gear 55 meshes constantly with gear 54 and thus rotates therewith. Since pipe 63 is coupled to gear 55, it also rotates 360 degrees in small increments which rotates brushes 66, 67. The rudder 41 moves up and down only a single stroke during a single rise or descent. This rotates gear 53 only one notch at a time during such ascent or descent.

The shoulder 36 stops the upward movement of piston 28. When the device 10 becomes buoyant enough to reach the water surface, wall 26 moves towards section 11, permitting the air in sections 11, 12 to escape through holes 39 and water to enter through holes 13A to replace the air. This lowers the buoyancy of device 10, causing it to descend. Simultaneously, rudder 41 moves gear 53 which in turn rotates gears 54 and 55, which rotate sections 11, 12. This changes the direction of the line connecting portions 42A, 42B of collar, causing the device to change direction in its lateral movement.

As device 10 descends, the rudder 41 moves to the solid line position in FIG. 1 with one end up in the water and the other end down imparting erratic movement and brushing of the walls of the pool if engaged by device 10. Of course, during this entire time pool water is being drawn into the interior of port 62 (FIG. 1) as indicated by the arrows, through a wall opening 87 in pipe 63 and into and up hose 73 to pump 78 and filter 83 via line 80 (FIGS. 4 and 5) all as is well known in the art. When device 10 reaches the pool bottom, it sits there until sufficient air enters it via hose 74 to begin again the cleaning cycle. Of course, air line 74 may be operated by suitable timing devices either separate from pump 78 or associated therewith.

As rudder 41 moves either up or down once during the rise and descent of device 10, gear 53 moves gear 54 one notch as heretofore discussed.

As the gears are rotated one notch, sections 11 and 12 are rotated at a given angle relative to the pool. This ensures that the device is rotated relative to the pool within a certain rising or falling cycle of the device and that the device will move laterally in a different direction than that in the previous cycle. This feature increases the probability that the device will reach most or all areas of the pool to clean such areas. If further ensures that the device can retrieve itself from any corner of the pool. If the gears 53–55 are such that they are rotated one notch only when rod 51 moves plate 56 in one direction, then sections 11 and 12 are rotated one notch only upon the rising or falling part of the cycle.

While the rotation mechanism is described above in the preferred embodiment by means of gear mechanisms, it will be understood that other rotational mechanisms may be used as long as they can be automatically activated by the rudder in its upward and downward movement described above. Such mechanisms may also be used and are within the scope of this invention. While in the preferred embodiment, three gears are used, two may be sufficient; such variations are within the scope of the invention. While air is injected in the device to give buoyancy, it will be obvious that other gases may also be used. In the preferred embodiment, air lines 74 is inserted through hose 74 so that the operator needs to handle only one hose instead of the hose and an air line. It will be obvious, however, that other ways of connecting the air injection means to the device may be used which are also within the scope of the invention.

The function of disc 12' will now be elaborated. When the operator stops cleaning the pool by shutting the air supply, sometimes the device may be flipped upside down at the bottom of the pool. When this happens, it may be troublesome to retrieve the device since, when the air supply is turned back on, the air simply escapes through the bottom opening of the device now positioned on top. Disc 12' has a funnel portion 302 defining a hole 304 as shown in FIG. 1. When the device is in the upside down position, at least some of the air injected when the air supply is again turned on will be trapped by the disc. This will increase the buoyancy of the device and cause the device to float, thereby facilitating its retrieval.

Any suitable materials may be used. For example, ballast 64 may be be plastic, resin and sand mix, etc. A removable screen may be provided across the opening into port 62. This may be accomplished by having screen 88 snap fitting thereto and of a suitable mesh size to collect debris of a predetermined size, such as ¼ inch mesh.

Preferably there are 40 teeth to on each gear 53 to 55 so that a gentle gliding pattern is imparted to device 10 as it rises and falls in the pool. The device 10 will move back and forth in the pool between the shallow and deep end, changing direction when it hits the walls at each end. Optionally filter screen 88 keeps out large debris that could clog device 10.

Figure 7:
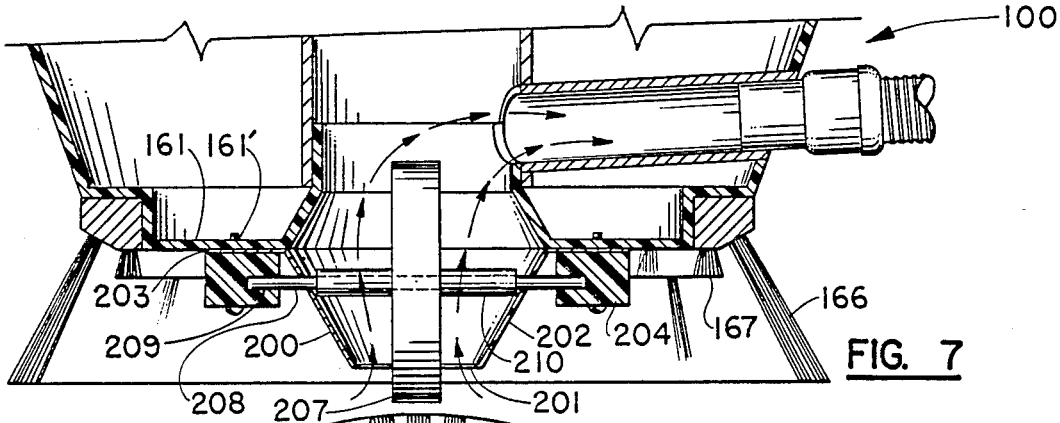
FIG. 7 is a partial elevational view of a second embodiment of the invention.
Figure 8:
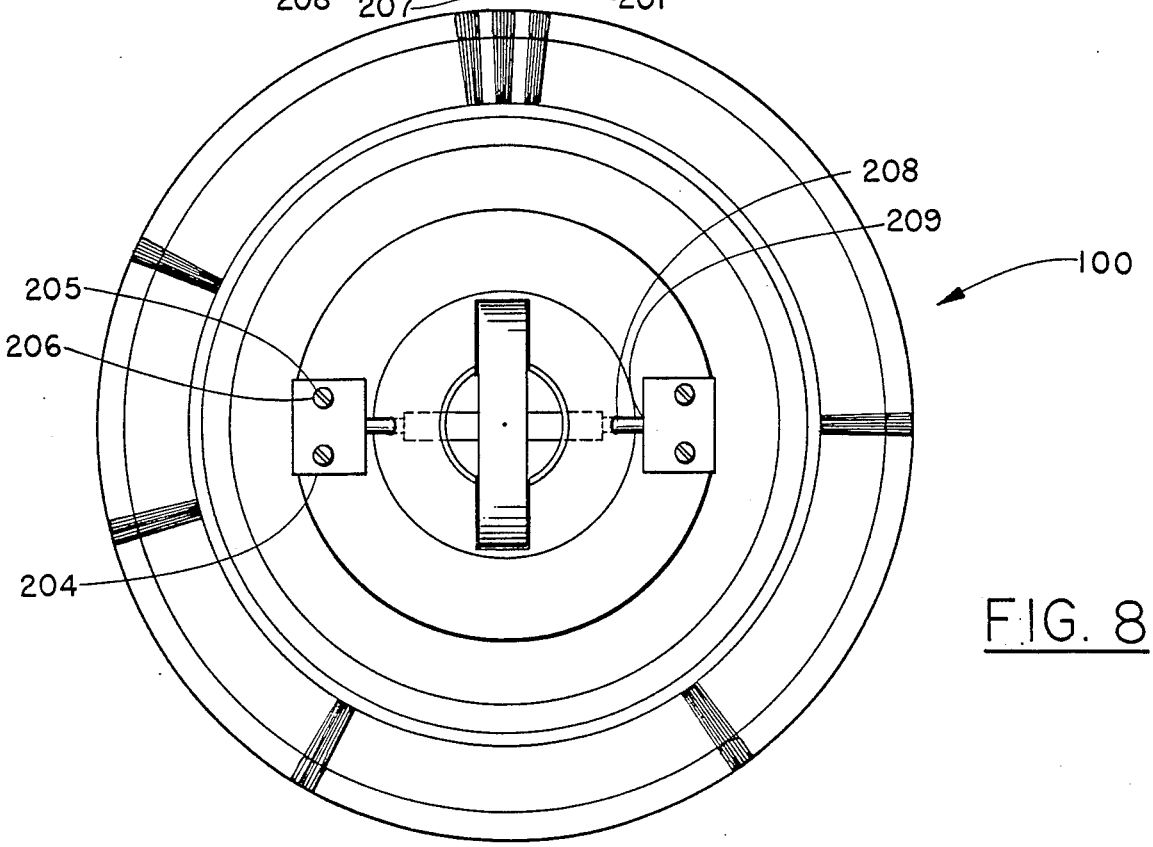
FIG. 8 is a bottom plan view of the second embodiment of the invention.

Turning now to FIG. 7, we find a partial elevation of a second version of the instant device. In this embodiment, which is operationally the same as the first embodiment, the brush retainer 165 is smaller and more streamlined, i.e., it does not extend out from the main portion of the device. Brush retainer 165 has a divergent annular brush 166 emanating therefrom, as well as optional downward extending annular brush 167.

Mounted on the bottom wall 161 in suitable bores 161' not seen is a cup shaped retaining member 200. Retaining member 200 includes a bottom circular ring section 201 which is open on the inside to permit water flow in the manner previously described with respect to the FIG. 1 embodiment. An outwardly angled side wall 202 circumstances ring 201, and terminates in a circular flange 203 which is parallel to bottom ring 201. This flange includes a plurality of spaced bores, here 4, and designated 203' at locations that will align with the bore 161' in bottom wall 161. Preferably these last mentioned bores are threaded to receive bolts 206 as will be described.

A water resistant block 204 such as of polyurethane having a pair of spaced aligned bores 205 is disposed over said flange 203 such that the bores 205 align with the other bores previously mentioned for mounting of the blocks 204. Each block 204 also includes an inward facing recess 209 sized to receive axle 208.

Thus one of the blocks 204 is first secured by threaded bolt 206 through the bores aforementioned in block 204, and flange 203 to the bottom wall 161. Axle 208 is inserted into the recess 209, a bushing 210 to limit sideward movement of wheel 207 is inserted on the axle 208. The wheel 207 is mounted on the axle; the other bushing 210 added, and the cup retainer 200 located such that the other bores of the flanges 203 align with the bores in bottom wall 161. Obviously this is most easily accomplished by inversion of the device 100. The axle opposite end is inserted into the recess of the second block 204, and the threaded bolts 206 secured to retain the device in place.

It has been found that the use of the wheel 207 enhances the movement of the device 100, especially in sloped areas of the pool such as going from the shallow to the deep end of the pool. In addition, some extra dirt can be picked up if the device is in the same plane as the surface of the pool in the inclined area of the pool.

It can be seen that I have disclosed a pool cleaner which can brush the sides and bottom of a pool while simultaneously vacuuming the pool. The pool cleaner of my invention carries this out in a single economical operation and creates water movement in all regions of the pool. Such movement retards the growth of algae. The device has its own air pump which may be as low as 1/20th of a horsepower and is operated independently of the pool pump. The device brushes the pool and lifts each particle of dirt in the pool as it rises and falls in the pool. The amount of suction to the device 10 may be controlled along with the conventional pool suction so the device alone may vacuum, or the pool pump alone via the main drain, or a combination of both. The bottom of the device bearing the brushes rotates in operation and thus eliminates tangling problems.

Various materials known in the art may be employed in the manufacture of the instant device. Suitable plastics include ABS, polycarbonate and less preferably PVC. While it is suggested that the upper section be made of spun stainless it too can be made of the plastics aforesaid. Of course, any metal parts such as the lever should be of non-rusting metal such as brass or bronze.

While it has been indicated that a directional change takes place upon impacting the wall at the side or end of the pool, the direction of movement also changes upon the device rising and falling as it traverses the pool.

Since certain changes may be made in the above apparatus without departing from the scope of the invention herein involved, it is intended that all matter contained in the above description or shown in the accompanying drawings, shall be interpreted as illustrative and not in a limiting sense.

I claim:

1. A pool cleaning device comprising:

a housing adapted to be submerged in a pool of water, said housing defining therein a chamber for holding gas;

means for supplying a gas to the chamber to apply a lifting force to the housing, causing the housing to rise towards the surface of the water in a rise cycle;

means for releasing the gas in the chamber and to allow the entry of water into the chamber to replace the gas released, thereby causing the housing to fall towards the bottom of the pool in a fall cycle; and means attached to the housing for cleaning the pool when the housing rises and falls in the water.

2. The device of claim 1, said housing further defining an outlet means in communication with the chamber, wherein said releasing means comprises means for controlling the outlet means to release the gas in the chamber through the outlet means into the water and to allow the entry of water into the chamber through the outlet means when the housing is at a predetermined distance to the water surface, thereby causing the housing to fall towards the bottom of the pool.

3. The device of claim 2, said controlling means comprising a valve attached to the housing, wherein said valve opens the outlet means when said valve is at or above the water surface, and closes the outlet means when it is submerged.

4. The device of claim 3, wherein said housing has an upper end and a lower end, said device further comprising means for maintaining the upper end above the lower end, and wherein said outlet means is at the upper end of the housing and said valve is attached to the upper end of the housing.

5. The device of claim 4, said pool having a bottom surface, said device further comprising means connected to the lower end of the housing for moving the housing on the bottom surface of the pool.

6. The device of claim 1, wherein said cleaning means includes abrasive means attached to the outside surface of the housing for cleaning the surface of the pool.

7. The device in claim 1, further comprising rudder means connected to the housing for causing lateral motion of the housing when the housing rises or falls.

8. The device of claim 7, wherein the gas supplying means and outlet controlling means cause the housing to rise and fall consecutively in consecutive rise and fall cycles, said device further comprising means for causing the lateral motion of the housing to change direction after each rise or fall cycle to enable the device to move to different areas of the pool.

9. The device of claim 1, further comprising means for partitioning the chamber into a first and a second portion, wherein the first portion is suitable for holding gas, wherein said gas supplying means supplies gas to the first portion and the releasing means releases gas held in the first portion, the first portion holding at least some gas and the second portion holding water after gas is supplied to the first portion, causing the first portion to be above the second portion.

10. A pool cleaning device comprising:

a housing;

means for causing the housing to consecutively rise and fall in a pool of water;

rudder means connected to the housing for causing lateral motion of the housing when the housing rises in a rise cycle or falls in a fall cycle; and means attached to the housing for cleaning the pool when the housing rises or falls.

11. The device of claim 10, said rudder means comprises a plate means connected to the outside surface of the housing so that said plate means is movable between two slanting positions, said plate means being in one position during the rise cycle and the other position during the fall cycle.

12. The device of claim 11, said device further comprising means for causing the lateral motion of the housing to change direction after each rise or fall cycle to enable to device to move to different areas of the pool.

13. The device of claim 12, wherein said housing comprises two portions rotatable relative to each other, said rudder means being attached to one of the portions, wherein said direction change causing means rotates the two portions relative to each other to change the direction of lateral motion.

14. The device of claim 13, wherein the portion to which the rudder means is attached to is lighter than the other portion so that when the direction change causing means causes the two portions to rotate relative to each other, the heavier portion remains substantially stationary and the lighter portion is rotated, causing the rudder means to be rotated relative to the pool.

15. The device of claim 10, wherein said housing defines a chamber therein for holding gas, and wherein said rise and fall causing means comprises:

means for supplying a gas to the chamber to apply a lifting force to the housing, causing the housing to rise towards the surface of the water in a rise cycle; and means for releasing the gas in the chamber into the water and to allow the entry of water into the chamber, thereby causing the housing to fall towards the bottom of the pool in a fall cycle.

16. The device of claim 10, wherein said housing has an upper end and a lower end, said device further comprising means for maintaining the upper end above the lower end.

17. The device of claim 10, said pool having a bottom surface, said device further comprising means connected to the lower end of the housing for moving the housing on the bottom surface of the pool.

18. The device of claim 10, wherein said cleaning means includes abrasive means attached to the outside surface of the housing for cleaning the surface of the pool.

19. A pool cleaning system which comprises:

a housing adapted to be submerged in a pool of water, said pool having a surface, said housing defining a hollow chamber having an opening therein for passage of water and air between said chamber and the pool of water;

means for supplying air to the opening of said chamber when said chamber is filled with water for the purpose of displacing water in said chamber, so that when a predetermined proportional of the water in the chamber is displaced, the chamber becomes bouyant and rises to the surface of the pool;

a rudder surrounding the exterior of said chamber and pivotally connected thereto;

means within said chamber connected to said rudder for the purpose of rotating said housing upon the pivotal movement of the rudder;

abrasive means attached to said rudder for cleaning the pool surface;

means connected to said housing for releasing air from said chamber for the purpose of allowing water to flood said chamber and thereby causing the chamber to sink to the floor of the pool;

means within said chamber for separating water and air for the purpose of keeping the air in the upper portion of said chamber and thereby keeping the vessel vertical;

a weighted bottom housing coupled to the bottom of said chamber, being sufficiently weighted to cause the chamber to sink to the bottom of the pool when a predetermined proportion of the chamber is filled with water;

means for connecting the weighted bottom housing to a pool vacuum hose to the water in the pool for supplying pool water and debris to said vacuum hose;

an abrasive means attached to the weighted bottom housing; and a means attached to said weighted bottom housing for providing mobility to said weighted bottom housing when on the pool floor.

* * * * *